US011744336B2

(12) United States Patent
Kinback et al.

(10) Patent No.: US 11,744,336 B2
(45) Date of Patent: Sep. 5, 2023

(54) WALKING CANE WITH INTEGRATED ASSISTED SIT-TO-STAND LIFTING DEVICE

(71) Applicants: Nicholas Craig Kinback, Wilmore, PA (US); Ryan Thomas Kinback, Wilmore, PA (US); Cody James Kinback, Wilmore, PA (US)

(72) Inventors: Nicholas Craig Kinback, Wilmore, PA (US); Ryan Thomas Kinback, Wilmore, PA (US); Cody James Kinback, Wilmore, PA (US)

( * ) Notice: Subject to any disclaimer, the term of this patent is extended or adjusted under 35 U.S.C. 154(b) by 0 days.

(21) Appl. No.: 17/360,851

(22) Filed: Jun. 28, 2021

(65) Prior Publication Data

US 2022/0104593 A1 Apr. 7, 2022

Related U.S. Application Data

(60) Provisional application No. 63/087,244, filed on Oct. 4, 2020.

(51) Int. Cl.
*A45B 9/02* (2006.01)
*A45B 3/00* (2006.01)

(52) U.S. Cl.
CPC . *A45B 9/02* (2013.01); *A45B 3/00* (2013.01)

(58) Field of Classification Search
CPC ..... A45B 3/00; A45B 9/02
See application file for complete search history.

(56) References Cited

U.S. PATENT DOCUMENTS 3,318,560 A * 5/1967 Garrette, Jr. ..... E04H 12/182 52/165
3,584,821 A * 6/1971 Glebe ..... F41A 23/04 248/156
3,912,209 A 10/1975 Turpin
4,616,668 A 10/1986 Battiston
5,000,418 A * 3/1991 Vogt ..... A45B 1/04 248/689
5,904,167 A * 5/1999 Moye ..... A45B 7/005 135/65

(Continued)

FOREIGN PATENT DOCUMENTS

CN 108523335 A 9/2018
GB 2110081 A 6/1983

(Continued)

OTHER PUBLICATIONS

"Able Life Universal Standing Handle Plus, Lift Aid to Transfer Senior, Elderly, Bariatric, or Handicap Patient, Assists Caregiver or Nurse, Replacement for Gait Belt—Blue with Rubber Grip" (Accessed Feb. 10, 2021).

(Continued)

*Primary Examiner* — Noah Chandler Hawk
(74) *Attorney, Agent, or Firm* — METZ LEWIS BRODMAN MUST O'KEEFE LLC

(57) ABSTRACT

A walking cane may be transformed into an assistive device for sit-to-stand transfers. The device has two sets of opposing handles, which are to be grasped by the user and an assister during sit-to-stand transfers. The transformation is accomplished by deploying a second set of handles by pivoting or rotating from a stored to a utility position. The assistive device form can then be reversed by the user once standing by reversing the deployment.

9 Claims, 5 Drawing Sheets

(56) References Cited

U.S. PATENT DOCUMENTS

| | | | | |
|---|---|---|---|---|
| 7,087,002 | B2 | 8/2006 | Montgomery | |
| 8,919,362 | B1 | 12/2014 | Mortenson | |
| 9,089,194 | B2 | 7/2015 | Tessier | |
| 2013/0192651 | A1* | 8/2013 | Goldman | A45B 9/02 135/65 |
| 2017/0224072 | A1* | 8/2017 | Van Varick | A45B 9/04 |
| 2021/0093056 | A1* | 4/2021 | Liu | A45B 9/02 |

FOREIGN PATENT DOCUMENTS

| | | | |
|---|---|---|---|
| KR | 101309475 | | 9/2013 |
| KR | 101433339 | B1 | 8/2014 |
| KR | 20190118877 | A | 10/2019 |

OTHER PUBLICATIONS

"Liberty Lift 15 Standing Aid and Handicap Bar with No-Slip Grip Handles 400lbs Weight Capacity As Seen On TV" (Accessed Feb. 10, 2021).

"Vive Lift Assist—Patient Lifting Stand for Elderly and Disabled—Medical Safety Standing Loop—Universal Transfer Device for Senior, Caregiver, Therapist, Nurse—Lightweight Mobility Aid (2 Pack)" (accessed Feb. 10, 2021).

* cited by examiner

WALKING CANE WITH INTEGRATED ASSISTED SIT-TO-STAND LIFTING DEVICE

CROSS-REFERENCE TO RELATED APPLICATIONS

The present application claims the benefit of U.S. Provisional Application Ser. No. 63/087,244, filed on Oct. 4, 2020, the contents of which are incorporated herein by reference in their entirety.

FIELD OF THE INVENTION

The present invention relates to a dual purpose apparatus for assisting disabled individuals in walking and sit/stand movement. More specifically, the invention relates to a walking cane with an integrated second handle which can be selectively extended to provide a sit to stand assist and stored within the device while walking. The scope of the invention also includes more formal designations of single-point canes and other less common variations of canes, such as quad canes.

BACKGROUND OF THE INVENTION

The population demographics of the USA and much of the developed world is skewing older, particularly with the Baby Boomers becoming senior citizens. Therefore, a growing number of the population requires assistance with regard to mobility including the use of a walking cane (WC). WCs typically assist users with issues in balance, strength, and fall prevention. There are numerous WCs in the market with an abundance of modifications such as adjustable length, various handle forms, and even collapsible designs. However, a significant limitation with WCs is that they work while the user is already in the standing position but offer little assistance in transfers. Many of the same users who lack strength, flexibility, and balance for any number of reasons are likely to also have issues transferring from a sit-to-stand (STS) position. While assistive devices (AD) are used in a wide range of settings, including hospital, rehab, and home, they are often large, heavy, cumbersome, and costly. Currently there are none that are integrated as a transformable component into a WC. Combining a WC and an AD for STS transfers has many potential benefits, including but not limited to being portable, light weight, cost effective, and practical for everyday on-the-go use.

BRIEF SUMMARY OF INVENTION

The present invention relates to a novel WC that transforms between two active forms: an ambulatory form and an AD form. The present invention transforms between the aforementioned forms when a simple, integrated, novel mechanism is deployed by the user. The ambulatory form functions as a conventional WC. The AD form of the novel device is comprised of two opposing grips, one for the user and one for the assister. The user's grip is a modification of the standard WC handle allowing an ergonomic and stable two-handed hold. The assister's grip is integrated into the inferior portion of the shaft of the WC and is comprised of a rotating cane bottom that is deployed to form a two-handed grip. The function of the AD form is to easily allow the assister to aid the user, who has difficulty with transfers, in going from a seated or recumbent position to standing, or STS. This is accomplished by the user deploying the AD form, grasping firmly onto the user side grips while the assister grasps the opposing grips. Once in position, the assister provides a pulling force, typically by leaning backwards, in the opposite direction of the user thereby helping them go from a STS position. Once the user is standing, the deployment is easily reversed and the WC can be used to ambulate in the typical fashion.

These and other advantages and features of the present invention will be more fully understood upon reference to the presently preferred embodiments thereof and to the appended drawings.

DETAILED DESCRIPTION OF THE INVENTION

Figure 1:
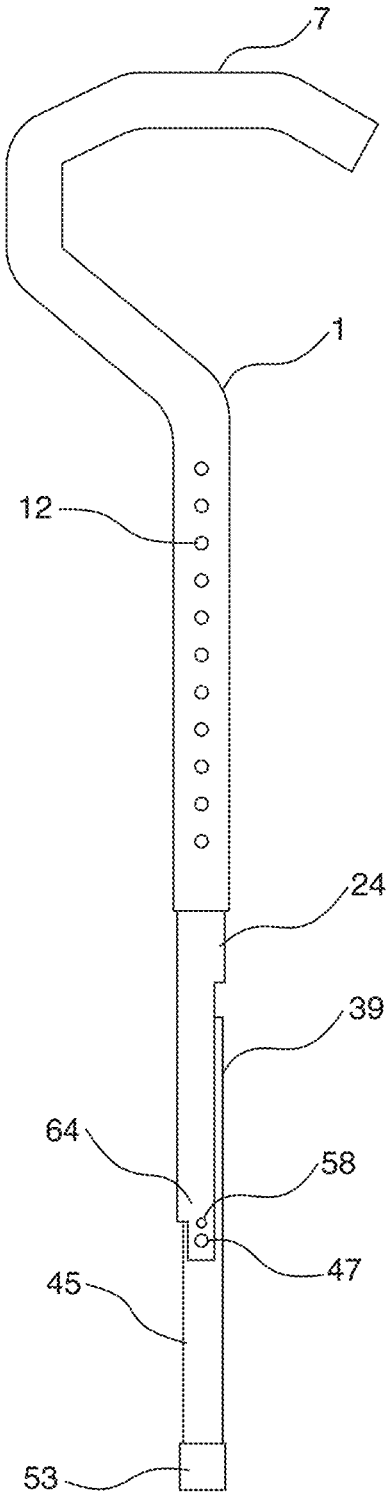
FIG. 1 is a side view of the cane for use in ambulation according to the present invention.
Figure 2:
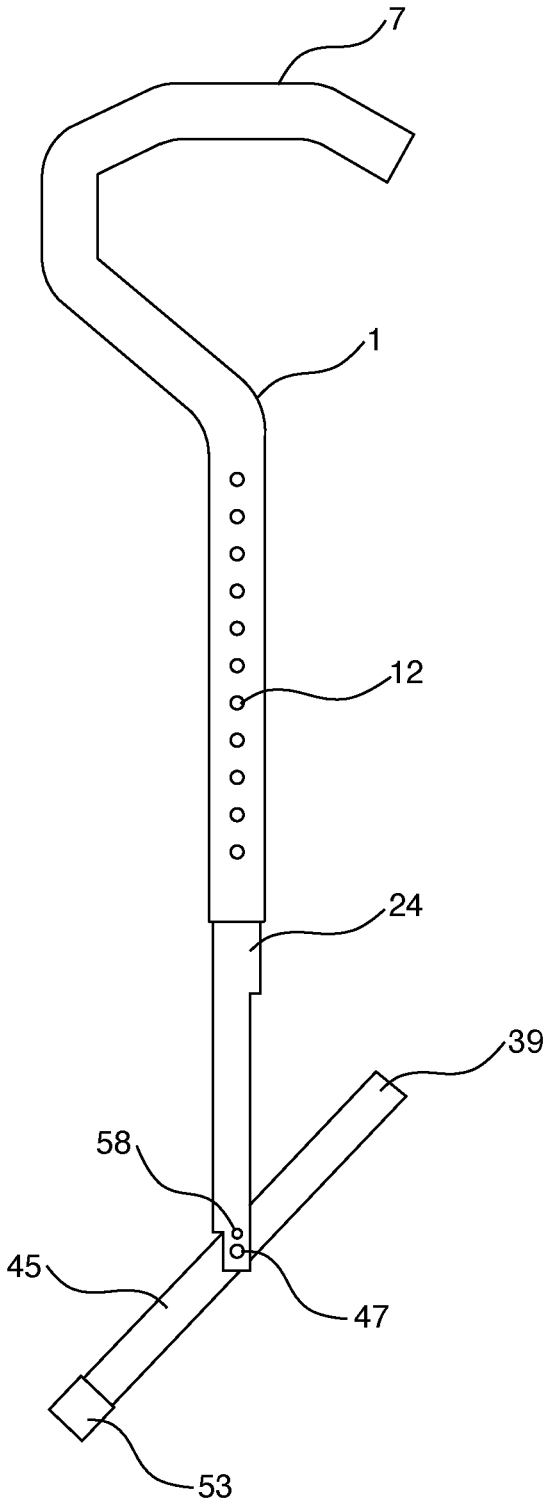
FIG. 2 is a side view of the cane demonstrating midway through the transition in deployment to assistive device (AD).
Figure 3:
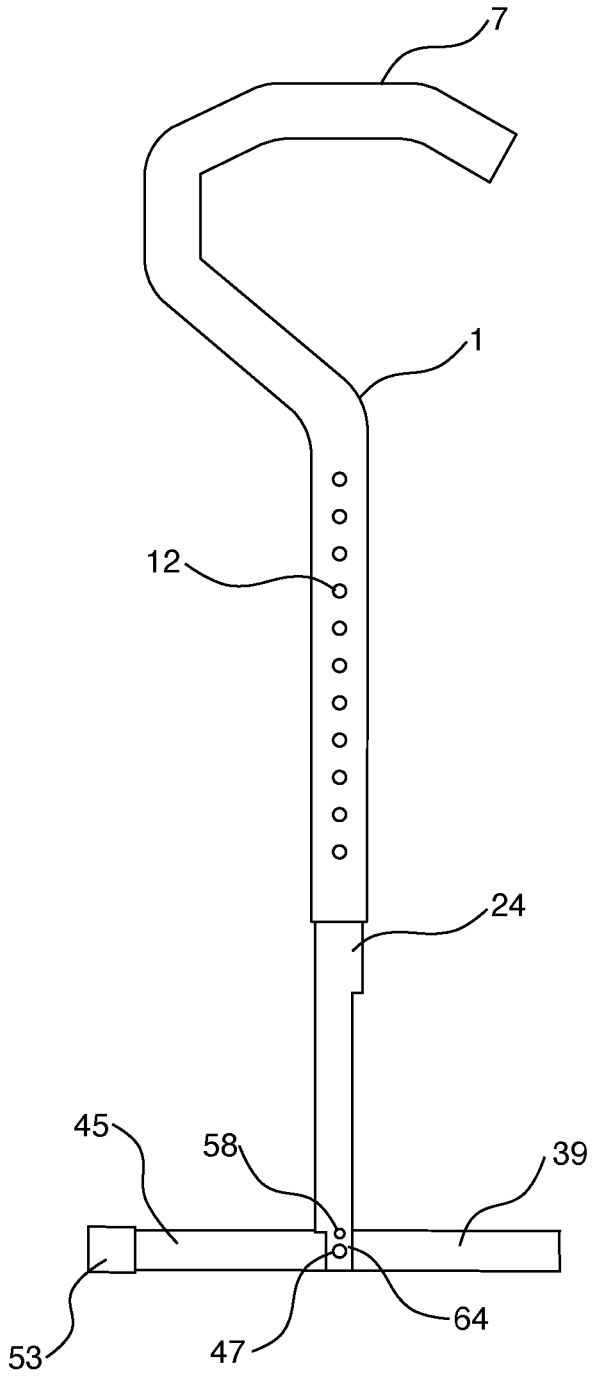
FIG. 3 is a side view of the cane in full deployment of the AD form.
Figure 4:
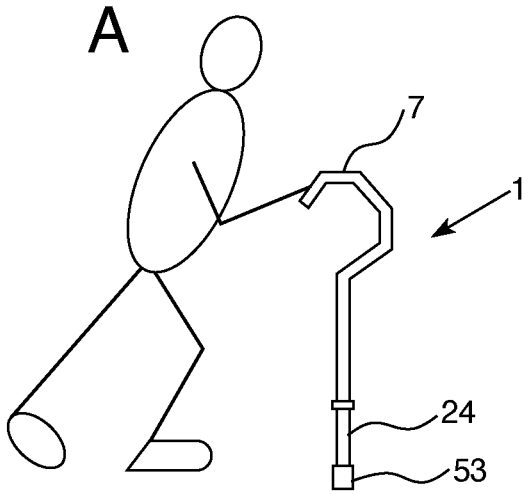
FIG. 4 is a diagrammatic illustration of the cane in use in the WC and AD forms.
Figure 4:
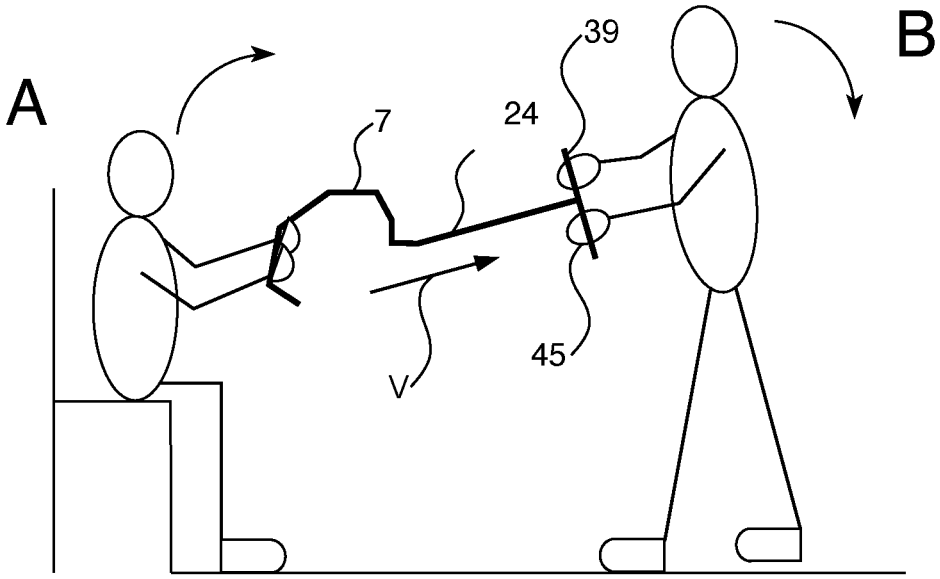
Figure 5B:
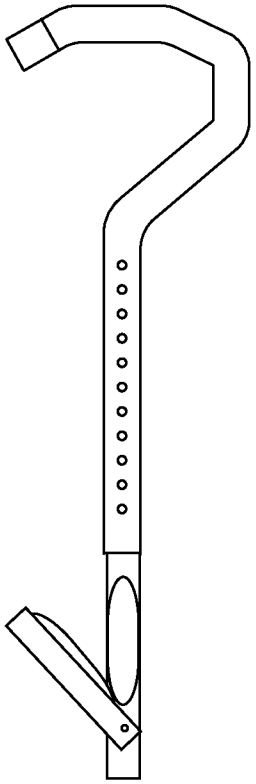
FIGS. 5A and 5B are side views of a second embodiment of the cane in the closed, ambulatory WC form.

With reference to the drawings, one manifestation of the present invention is generally referred to in FIGS. 1-5. FIG. 1. shows a static side view of the present invention in its use as a WC. FIG. 2. shows the mechanism used to deploy the present invention from a WC to an AD form with two sets of opposing grips. FIG. 3. shows a static side view of the deployed AD form. FIGS. 4 and 5 show alternate embodiments of the present invention in the ambulator and assistive device forms respectively.

The present invention, as shown in FIGS. 1-6, is generally comprised of an upper and lower portion, with the demarcation between them being the adjustable portion of the cane similar to conventional canes. The upper portion of the cane will be referred to as a main or Upper Cane Body 1, which is one continuous structure comprised of Cane Handle 7 and Adjustable Pin-Hole System 12. Upper Cane Body 1 could be composed of high-strength, lightweight aluminum alloy. Cane Handle 7 is comprised of a rubber, foam, or other synthetic grip which covers the aluminum alloy frame designed to fit the user's hand just as any common cane. Cane Handle 7, in addition to being used in the typical WC fashion, has a tapered and/or angulated handle along its curvature allowing it to function as an ergonomic two-handed grip in the AD form. When used as an AD, Cane Handle 7 is held by the user with two hands so that the base of the WC is outstretched towards the assister who provides a pulling force thereby aiding in the STS transfer. Adjustable Hole System 12 along the shaft of Upper Cane Body 1 allows the user to adjust the length of the cane and is comprised of a series of evenly spaced holes and a locking push-pin, as is commonplace in the cane industry, although other methods of adjustment could be used and still be within the scope of the invention. To adjust the cane length, the user would push the pin in interlocking Adjustable Hole System 12 unlocking Upper Cane Body 1 from the inferior portion of the cane, which is a slidable, interlocking shaft mounted interior or exterior to Upper Cane Body 1 referred to as Lower Cane Body 24. Then the user slides the shaft to the desired position based on the user's height and allow the pin to lock in place.

Lower Cane Body 24 is a cylindrical shaft structure made of aluminum alloy or similar material associated with the Upper Cane Body 1 in a single telescoping manner. Lower Cane Body 24 is connected to Upper Cane Body 1 by the aforementioned Adjustable Hole System 12 via the push-pin. The inferior most portion of the cane is comprised of a pivoting secondary handle portion, including Internal Assister Handle 39, Cane Base Assister Handle 45, Pivot Pin 47, Cane Base 53, Push-Pin Hole 58, and Assister Handle Locking Push-Pin 64. Lower Cane Body 24 is attached to both Internal Assister Handle 39 and Cane Base Assister Handle 45, which are continuous with each other, by Pivot Pin 47. There is a cut-out section on one side of Lower Cane Body 24 that acts as an opening to allow Internal Assister Handle 39 to fit within the cane body when in the ambulatory form. Internal Assister Handle 39 and Cane Base Assister Handle 45 rotate about the Pivot Pin 47 to alternate the present invention between the ambulatory form and the AD form. The deployment is accomplished by the user pushing Assister Handle Locking Push-Pin 64, then rotating the inferior portion of the cane (Cane Base Assister Handle 45 and Cane Base 53) 90 degrees around Pivot Pin 47 from a first WC position to a second AD position until Assister Handle Locking Push-Pin 64 locks and abuts closely the distal portion of Lower Cane Body 24 securing the present invention in the AD form, generally perpendicular to the axis of the Upper Cane Body 1 shaft section and Lower Cane Body 24.

In the AD form, the Internal Assister Handle 39 and Cane Base Assister Handle 45 are opposite to and oriented parallel to Cane Handle 7 and used by the Assister with a two-hand grasp to pull the user from STS. The deployment process is reversed to revert the AD form to the ambulatory form of the present invention: The Assister Handle Push-Pin 64 is pushed by the user to unlock the AD form (unlock means that the side of Assister Handle Push-Pin 64 is no longer in contact with the distal portion of Lower Cane Body 24), then Internal Assister Handle 39 and Cane Base Handle 45 are rotated about Pivot Pin 47 so that the Internal Assister Handle 39 moves in between the opening in Lower Cane Body 24 while Cane Base Handle 45 is oriented such that Cane Base 53 is the inferior most part of the cane. These handles when in the ambulatory form become straight with the same vector or axial direction of the line of holes in Adjustable Hole System 12. Internal Assister Handle 39 and Cane Base Handle 45 could be comprised of an additional rubber or synthetic grip overlying the aluminum alloy for comfort, a secure hold, and ergonomics of the assister's grasp. Cane Base 53 would be comprised of a rubber or synthetic bottom which could have a taper or flare to increase surface area and grip of the SPC when contacting the ground to increase safety and stability. Likewise, the rubber grip of Cane Base Handle 45 could be continuous with Cane Base 53. There are various ways to construct the handles, deployment method, and locking mechanism, but the purview of this invention is that comprised within the construct of a WC, there is an internal set of handles or similar grips that can easily be deployed and reverted back for quick and seamless STS and ambulation.

Figure 6B:
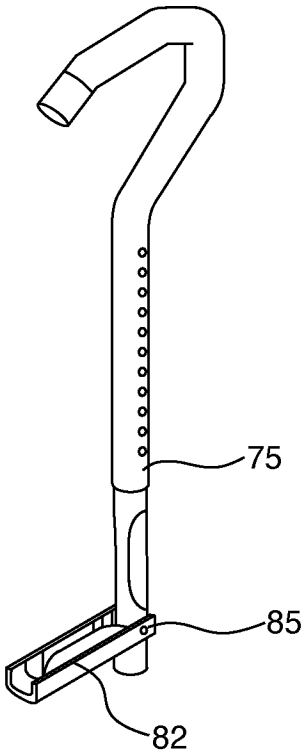
FIG. 6B is an isometric view of the second embodiment of the cane in the AD form.
Figure 6A:
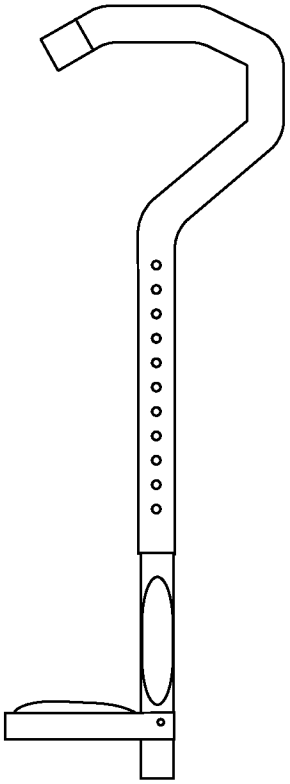
FIG. 6A is a side view of the second embodiment of the cane in the AD form.
Figure 5A:
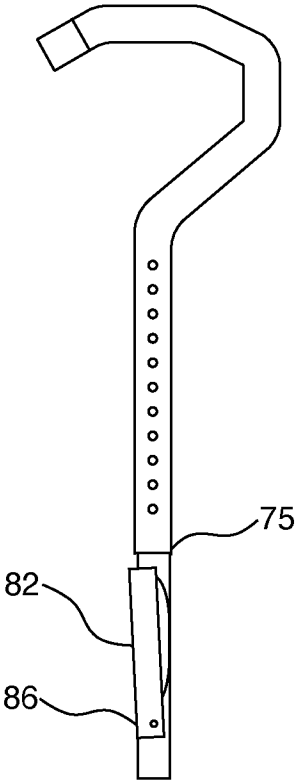

FIG. 5 and FIG. 6 are alternate embodiments of the present invention. In this embodiment, Integrated Assister's Handle 82 is generally semicircular in form and is mounted externally to and having the same general exterior shape as said Alternative Cane Base 75. FIG. 5A shows the cane in the closed or ambulatory position with the Alternative Cane Base 75 comprised of Integrated Assister's Handle 82 which is built into the same plane as the Alternative Cane Base 75. FIGS. 6A and 6B is the deployed or AD form of the second embodiment after the Integrated Assister's Handle 82 has been pivoted 90 degrees about the Alternative Pivot Point 86 from its previous position in FIG. 5. It can be appreciated that this form is just one of many variations that can function within the purview of the present invention, which is to utilize a walking cane as an assisted STS device for transfers.

The present invention is novel because in the ambulatory form, as shown in FIGS. 1 and 4 it performs as a typical WC, but when transformed into the AD form demonstrated in FIGS. 3-6 it acts as an AD. The deployment of the present invention as a WC into the AD form as demonstrated as the intermediary stage in FIGS. 2 and 5B is quick and simple, likened to adjusting the cane length or opening an umbrella. The deployment of the present invention typically would be performed in a seated position by the user just prior to standing. Once deployed, the AD form as shown in FIGS. 3-6, would be held by the user A by gripping Cane Handle 7 with the inferior portion of the WC outstretched toward the assister B who would hold Internal Assister Handle 39 and Cane Base Assister Handle 45. Once both user A and assister B have a firm grasp of their respective handles and are in position opposite each other, the user A would lean forward slightly, similar to any STS transfer (as indicated by arrows in FIG. 4) while the assister B would brace both legs and assume a slightly backward leaning posture with the goal of creating a force vector V away from and slightly upward from the forward facing user A. This force vector V allows the user A to receive aid initiating the most difficult portion of the STS transfer. Once the user A has assumed the standing position and is stably on their feet, the assister B can let go of the present invention and the user can return it to the ambulatory form as previously described. This is just one way that the present invention could be made and there are other mechanisms that would both aid a person as a WC and with STS transfers that are in the scope of the present invention.

While a present preferred embodiment of the invention is described, it is to be distinctly understood that the invention is not limited thereto, but may be otherwise embodied and practiced with the scope of the following claims.

What is claimed is:

1. A method of assisting a user to stand from a sitting position utilizing a walking cane having first and second ends, the first end including a fixed handle and said second end having a pivoting handle mounted thereon, said method comprising:

moving said pivoting handle from a first walking position in which said pivoting handle is generally aligned with said walking cane to a second assisting position in which said pivoting handle is extended outwardly from said cane;

having said user desiring to rise from a sitting position grip one of said first and second handles; and having an assisting person grip the other of said first and second handles;

having said assisting person exert a pulling force on said cane and said user, said user being assisted by said pulling force to rise from sitting to standing.

2. A method as described in claim 1, wherein said cane is first adjusted for the height of the user by modifying its length.

3. A method as described in claim 2, wherein said adjustment is accomplished by selecting one of a plurality of preselected relative positions of a multi-component cane in slidable relation to each other and engaging an interlocking mechanism at said position.

4. A method as described in claim 1, wherein said pivoting handle is pivoted 90 degrees from a generally axial position to a generally perpendicular position with respect to a central shaft of said cane.

5. A method as described in claim 4, wherein said pivoting handle is pivoted from a point generally central to the length of said pivoting handle, forming a handle on each side of said pivoting handle, as divided by the affixed shaft of the cane.

6. A method as described in claim 4, wherein said pivoting handle is pivoted from an endpoint of said pivoting handle, forming a handle on one side of the affixed shaft of the cane.

7. A method as described in claim 1, further comprising the step of returning the pivoting handle to the first position prior to resuming use of the cane as a walking aid.

8. A method as described in claim 7, wherein said pivoting handle is locked into said first position.

9. A method as described in claim 1, wherein said pivoting handle is locked into at least one of said first and second positions.

* * * * *